United States Patent [19]

Bandy

[11] Patent Number: 4,811,931

[45] Date of Patent: Mar. 14, 1989

[54] CLAMPING ASSEMBLY FOR A JACK

[76] Inventor: Harold C. Bandy, 4465 Yankee Rd., Jasper, Mich. 49248

[21] Appl. No.: 163,651

[22] Filed: Mar. 3, 1988

[51] Int. Cl.[4] ..... B66F 3/00

[52] U.S. Cl. ..... 254/134

[58] Field of Search ..... 254/133, 134, DIG. 4; 269/208, 209, 211, 133

[56] References Cited

U.S. PATENT DOCUMENTS

| | | | |
|---|---|---|---|
| 689,376 | 12/1901 | Young . | |
| 763,941 | 6/1904 | Butcher . | |
| 1,138,088 | 5/1915 | Crowel . | |
| 1,161,983 | 11/1915 | Schultz | 269/133 R |
| 1,283,795 | 11/1918 | Kelley . | |
| 1,483,004 | 5/1924 | MacDow . | |
| 1,541,306 | 6/1925 | Young | 254/133 R |
| 1,973,308 | 9/1934 | Geistlinger | 254/133 R |
| 2,456,375 | 12/1948 | Cedarholm | 254/134 |
| 2,516,483 | 7/1950 | Parker | 254/133 R |
| 2,962,262 | 11/1960 | Garver et al. . | |
| 3,220,691 | 11/1965 | Dudley | 269/208 |
| 3,909,889 | 10/1975 | Emerson | 269/209 |

FOREIGN PATENT DOCUMENTS 163466 6/1955 Australia .

*Primary Examiner*—Robert C. Watson

*Attorney, Agent, or Firm*—Jeffers, Hoffman & Niewyk

[57] ABSTRACT

A clamping attachment for a jack including two pivoting jaws secured to a frame by means of pivot pins. The pivoting jaws include portions which are contacted by a load inserted between the jaw faces whereby the load causes the jaws to pivot, thereby clamping the load between the jaw faces. The jaws are reversible for adjusting the space between the jaw faces. The jaws may also be fixedly pinned to the frame without pivoting movement. The jaws may be mounted at various positions on the frame to adjust the distance between the jaw faces.

15 Claims, 2 Drawing Sheets

CLAMPING ASSEMBLY FOR A JACK

BACKGROUND OF THE INVENTION

This invention pertains to a clamping attachment for a lifting jack and more particularly to a clamping attachment for a lifting jack which is actuated by the load supported by the jack.

Lifting jacks are well known in the prior art and may be either hydraulically or mechanically actuated. These jacks are commonly used to lift and support heavy loads such as, for instance, vehicles and farm equipment so that the equipment may be repaired. Many times such jacks must be used on surfaces other than level ground, for instance in a farmer's field or at the side of a road. When a jack is used under such conditions, it is possible that the load may shift on the jack and may even fall off, thereby possibly damaging the load or causing a potentially dangerous situation.

The need therefore exists for an attachment for a lifting jack having a pair of jaws which securely grasp and clamp the load thereby preventing shifting of the load on the jack.

SUMMARY OF THE INVENTION

The present invention, in one form thereof, overcomes the disadvantages of the above described prior art jacks by providing an attachment for a jack which securely clamps the load.

The clamping attachment, according to one form of the present invention, includes a pair of jaws which are held by a frame. When a load is placed between the jaws, the load will contact an activating surface of one or both jaws thereby causing the one or both jaws to pivot inwardly and securely grasp the load.

The present invention, in one form thereof, includes a frame consisting of a pair of generally elongated frame members having a plurality of pairs of aligned apertures therein. The frame includes a mounting member whereby the frame may be mounted onto a jack. Each of the jaws comprises a generally elbow shaped member, one leg of which includes a pivot aperture. The jaws can therefore be secured to the frame by pivoting pins which extend through the pivot aperture and through a pair of aligned apertures in the frame. Thus one leg of each the jaws extends upwardly from the frame and one leg is aligned with the frame. When a load is inserted between the upstanding legs of the jaws, the load will rest on the horizontally disposed legs of the jaws and thereby cause the jaws to pivot inwardly about the pivot point, whereby the upstanding legs grasp the load. One or both of the jaws may also be fixed in place so that no pivoting movement of the fixed jaw occurs when the load is placed between the jaws.

One advantage of the present invention is that the assembly securely grasps the load, thereby preventing shifting of the load on the jack and preventing potential damaging of the load or potentially dangerous situations due to the shifting of the load or due to the load falling off the jack.

Another advantage of the present invention is the fact that the jaws are reversible whereby the loading space between the jaws may be increased or diminished as desired.

A further advantage of the present invention is that the jaws may also be mounted fixedly on the frame whereby one of the jaws may be in the fixed position and the other jaw may be pivotable, as desired.

Still another advantage of the present invention is that the jaws and frame may be constructed so that the jaws are adjustably connected to the frame and therefore may be adjusted quickly to provide a greater or lesser amount of space between the jaws to handle narrow or wide loads.

The present invention, in one form thereof, comprises a clamping assembly for use with a jack. The clamping assembly includes a frame having two spaced apart parallel frame members. A plurality of apertures are included in each of the frame members and are arranged in a generally straight line. The apertures in the respective frame members are aligned in pairs. A mounting member is secured to the frame for mounting the frame on a jack. A first jaw includes a generally elongated first leg which is pivotably disposed between the parallel frame members for pivoting movement on a first pivot pin which extends through a first pair of the aligned apertures. The first jaw has a second leg extending at generally right angles to the first leg, and the second leg has a first jaw face thereon. A second jaw including a generally elongated third leg which is pivotably disposed between the parallel frame member for pivoting movement on a second pivot pin which extends through a second pair of the aligned apertures. The second jaw has a fourth leg extending at generally right angles to the third leg and the fourth leg has a second jaw face thereon juxtaposed to the first jaw face. The first and third legs have means thereon to contact the load which is disposed between the first and second jaw faces whereby the first and second jaws will pivot and the load will be clamped between the first and second jaws.

The present invention, in one form thereof, includes a clamping assembly for use on a jack. The assembly includes a frame and means for mounting the jack on the frame and a pair of jaws adapted to be mounted on the frame. At least one of the jaws has a mounting portion and a clamping portion connected thereto. The mounting portion includes a first means for pivotably mounting the jaw on the frame. The mounting portion further includes means for contacting a load to be inserted between the jaws, whereby the one jaw is pivoted toward the other jaw.

The present invention, in one form thereof, comprises a clamping assembly for use on a jack and comprising a frame including a generally elongated member and means secured to the frame for mounting the frame on a jack. A pivot pin is secured to the frame. A first jaw including a first generally elongated leg which is adapted to be pivotably mounted on the pivot pin with the first leg generally aligned with the frame. The first jaw includes a second leg connected to the first leg extending generally at right angles thereto, and further includes a first jaw face. A second jaw including a second jaw face is mounted on the frame juxtaposed to the first jaw face. The first leg includes a contact area for contacting a load inserted in the space between the first and second jaw faces thereby pivoting the first jaw whereby the first and second jaw faces will clamp the load.

It is an object of the present invention to provide a clamping assembly for a jack which is actuated by the load whereby the jaws of the assembly securely grasp and clamp the load.

Another object of the present invention is to provide a clamping assembly for a jack which can be easily mounted on a jack.

Yet another object of the present invention is to provide a clamping assembly for a jack wherein the jaw faces are adjustable to provide a greater or lesser amount of space between the jaw faces for handling narrow or wide loads.

Yet a further object of the present invention is to provide a clamping assembly for a jack wherein one or both of the jaw members may be secured fixedly to the frame of the clamping assembly.

A still further object of the present invention is to provide a clamping assembly for a jack wherein the jaws may be quickly adjusted with respect to the frame.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
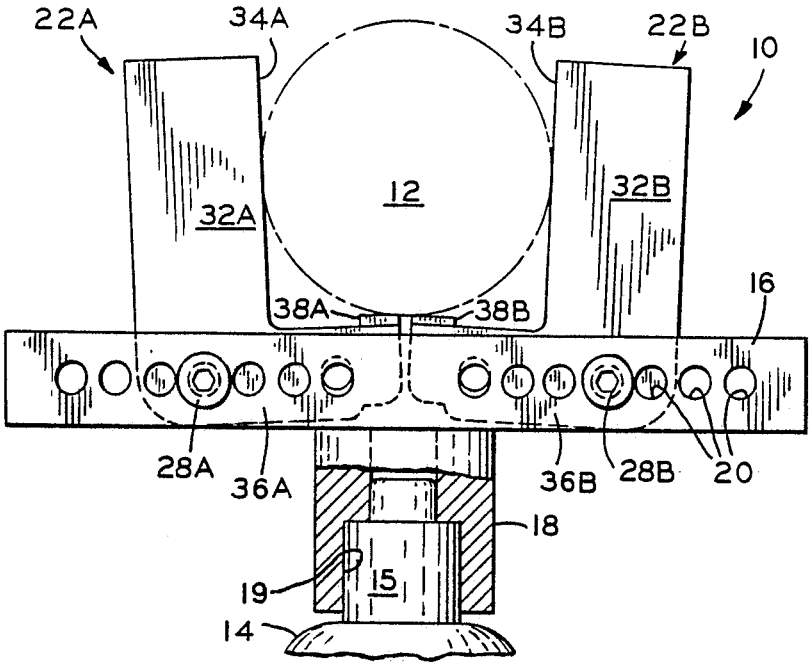
FIG. 1 is an elevational view of a clamping assembly according to the present invention with a load inserted between the jaws thereof.
Figure 2:
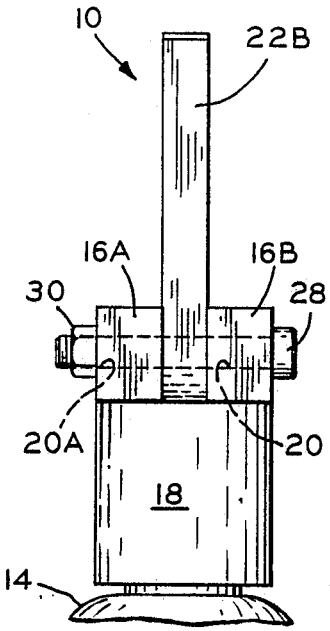
FIG. 2 is a side view of the clamping assembly of FIG. 1.

Referring to FIGS. 1–4, there is shown a preferred embodiment of the invention. FIG. 1 shows a clamping attachment 10 for clamping a load 12 which may comprise the axle of a vehicle. The attachment is mounted on a conventional jack 14 having a movable load bearing extension 15. The jack may be hydraulically operated to raise or lower extension 15 as desired. The clamping attachment includes a frame 16 comprising two parallel frame members 16A and 16B. The frame has secured thereto a mounting member or cup 18 having an aperture 19 therein which is shaped to conform to load bearing extension 15 of jack 14. It should of course be understood that while the invention is disclosed as being a separate attachment for a jack, the attachment could be made unitary with the jack and could be secured to extension 15 in any suitable manner such as, for instance, by welding or by mechanical fasteners. However, by making attachment 10 a separate assembly, the clamping assembly is more versatile.

Figure 3:
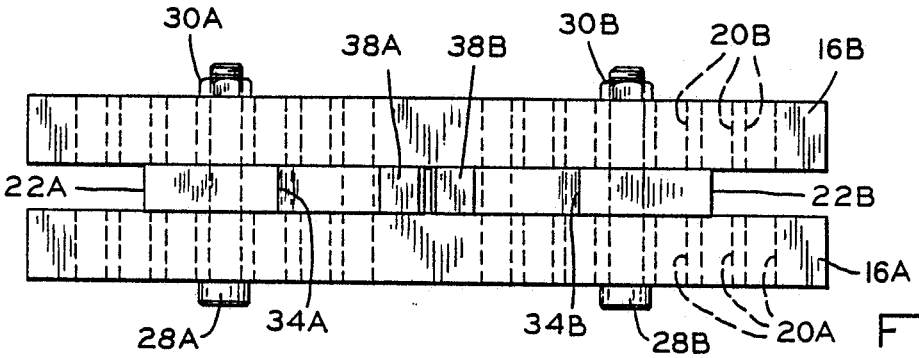
FIG. 3 is a top view of the clamping assembly of FIG. 1.

Frame members 16A and 16B respectively include a series of apertures 20A and 20B. Apertures 20A and 20B extend in a generally straight line along approximately the center line of frame members 16A and 16B, as shown. Furthermore, apertures 20A and 20B are so formed that they can be aligned, as best seen in FIG. 3 whereby the apertures form aligned pairs as further discussed hereinbelow.

Figure 4:
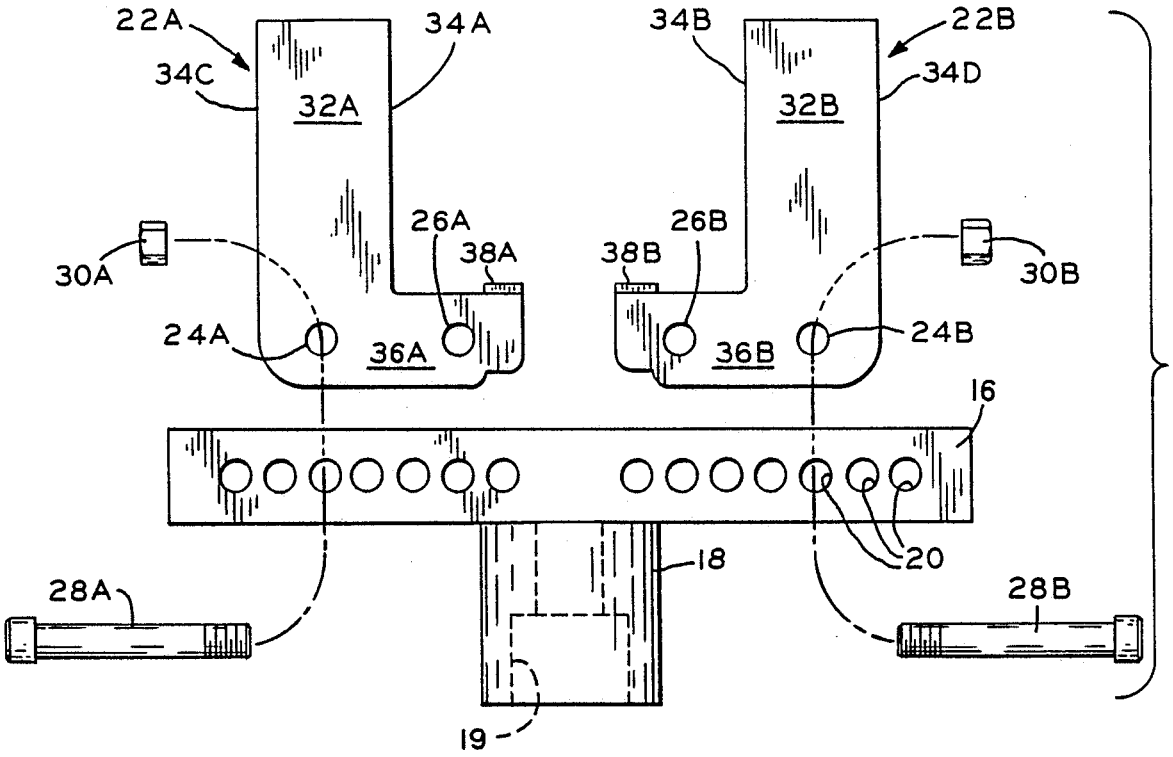
FIG. 4 is an exploded elevational view of the clamping assembly of FIG. 1.

Two jaws 22A and 22B are provided as best seen in FIG. 4. Each of the clamps includes a pivoting aperture 24 and a further aperture 26 for securing the jaws in fixed position to frame members 16A and 16B. A pair of pins 28A and 28B are provided, which in the preferred embodiment have been shown as a pair of bolts including nuts 30A and 30B. Each of the jaws 22 include an upright leg 32 and a horizontal leg 36 which extends at generally right angles to the upright leg. While, in its preferred embodiment, the upright leg has been shown as extending at 90° to the horizontal leg, it should be understood that this angle may be varied as desired. The jaws 22 also included jaw faces 34A, 34B, 34C and 34D on the upright legs as further explained hereinafter. Lastly, the jaws 22 include contact pads 38A and 38B located on horizontal legs 36A and 36B.

Referring now to FIG. 1, the operation of the assembly is shown. In the arrangement of FIG. 1, both of the jaws 22A and 22B are pivotably attached to frame 16 by means of pivot pins 28A and 28B. Thus, as can be seen when the load 12 is inserted between jaw faces 34A and 34B, the load will rest on contact pads 38A and 38B thereby causing upright legs 32A and 32B of jaws 22A and 22B to pivot inwardly about pivot pins 28A and 28B. Jaw faces 34A and 34B will therefore grasp and clamp load 12 and thereby prevent the load from shifting on the jack. It should be noted that contact pads 38A and 38B should extend slightly above frame 16 for proper contact with the load 12. In the arrangement of FIG. 1, the load is slightly wider than the space provided between upright legs 32A and 32B whereby the tops thereof are pushed slightly outwardly and whereby the load will rest fully on contact pads 38A and 38B.

Figure 5:
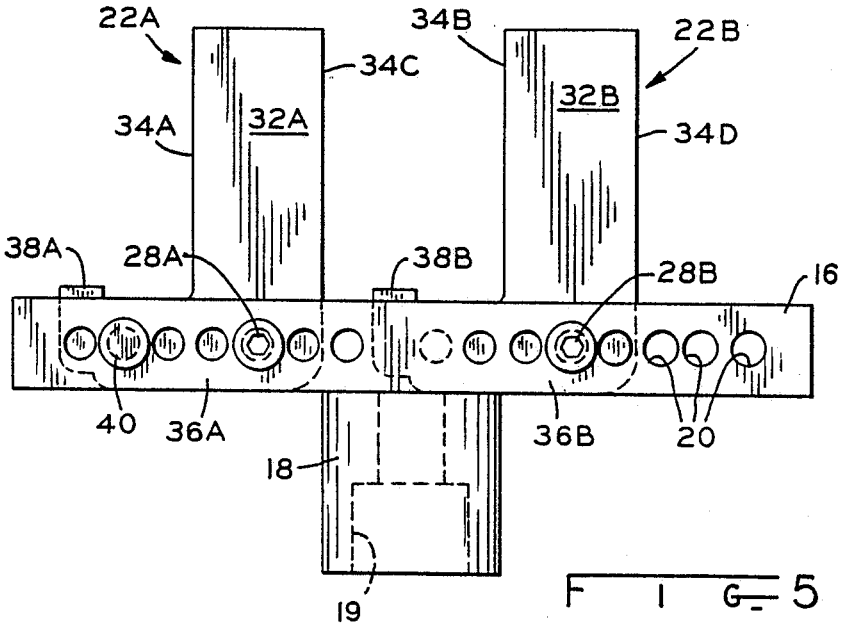
FIG. 5 is an elevational view of the clamping assembly of FIG. 1 with one of the jaws in a reversed position and fixedly secured to the fame.

It should be noted that, by providing a series of apertures 20, the jaws 22 may be mounted at different locations along frame 16 to accommodate wider or narrower loads. In the preferred embodiment of FIGS. 1–5, holes 20 have been spaced apart at ½ inch intervals. However, other arrangements are also possible. However, as can be seen in FIG. 1, jaws 22A and 22B may not be mounted closer in the arrangement shown as the horizontal legs 36 are almost in contact with each other. By referring to FIG. 5, it can be seen that a narrower opening between the upright legs 32A and 32B may be provided by mounting one of the jaws 22A in a reversed position. Therefore the jaw faces confronting a load will be faces 34C and 34B. If an even narrower space is desired between the upright legs 32A and 32B, the jaw 22B may also be reversed. However, it should be noted that by reversing a jaw, the pivoting action for that jaw will no longer be available. Therefore, in the position of jaws 22A shown in FIG. 5, another bolt 40 has been provided to securely pin jaw 22A in the non-pivoting position on frame 16. Therefore in the configuration of FIG. 5, only jaw 22B is pivotable, thereby causing the load to be grasped and clamped between faces 34B and 34C.

If it is desired to pin both jaws 22A and 22B in fixed positions, this may also be accomplished by simply inserting an additional pair of bolts 40 into apertures 26 in the arrangement shown in FIG. 1. In such an arrangement jaws 22 will not pivot but will be fixedly secured to frame 16.

Figure 6:
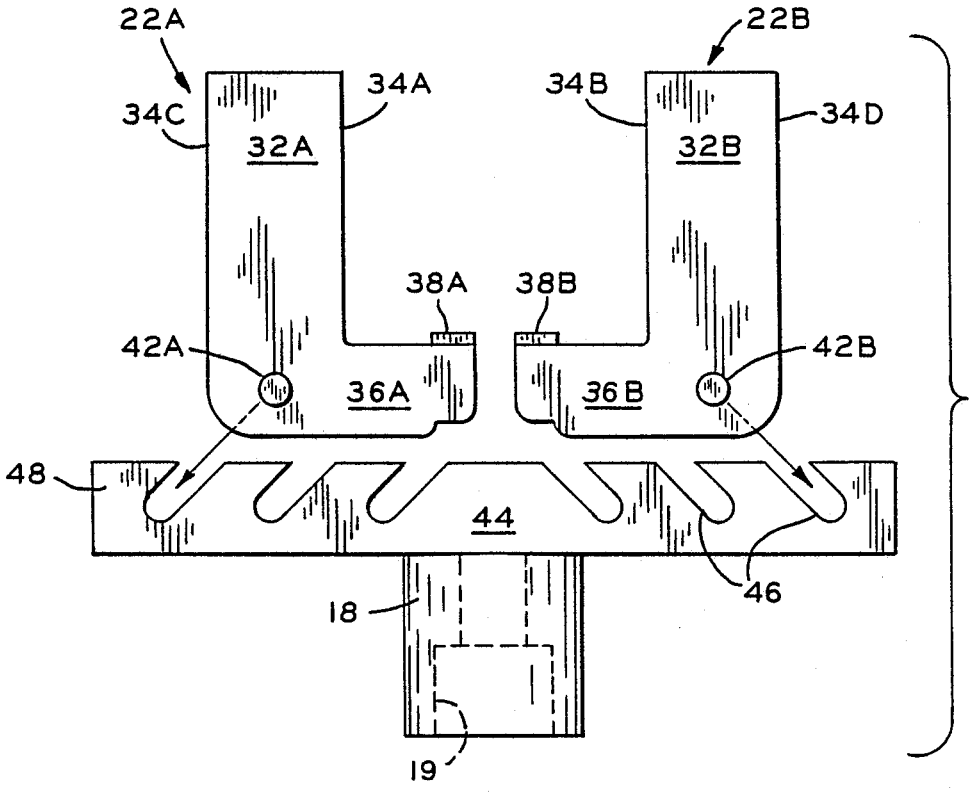
FIG. 6 is an exploded elevational view of another embodiment of the clamping assembly according to the invention.

FIG. 6 discloses a second embodiment of the invention. In this embodiment, the jaws 22A and 22B are virtually identical to those shown in the embodiment of FIGS. 1–5. However, instead of providing apertures 24 in the jaws, pins 42A and 42B are secured to the jaws. These pins extend away from both sides of the jaw members 22A and 22B. The pins are adapted to fit into slots 46 provided in frame 48. Thus, the rearrangement and adjustment of jaws 22 is very simple as they need merely be lifted to disengage from the frame and then reinserted with their pins 42 engaged with another slot 46. The slots 46 are provided at an inclined angle with respect to the vertical as this will ensure self tightening of the jaws 22 upon the loading of the clamping assembly.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A clamping assembly for use on a jack comprising:

a frame including two spaced apart parallel frame members;

a plurality of apertures in each said members, said apertures arranged in a generally straight line, said apertures in respective said members being aligned in pairs;

a mounting member secured to said frame for mounting said frame on a jack;

a first jaw including a generally elongated first leg pivotably disposed between said parallel frame members for pivoting movement on a first pivot pin which extends through a first pair of said aligned apertures, said first leg further including means for mounting said first jaw fixedly on said frame to prevent pivoting movement of said first jaw with respect to said frame, said first jaw having a second leg extending at generally right angles to said first leg, said second leg having a first jaw face thereon;

a second jaw including a generally elongated third leg pivotably disposed between said parallel frame members for pivoting movement on a second pivot pin which extends through a second pair of said aligned apertures, said second jaw having a fourth leg extending at generally right angles to said third leg, said fourth leg having a second jaw face thereon juxtaposed to said first jaw face;

means on respectively said first and third legs for contacting a load disposed between said first and second jaw faces, whereby said first and second jaws will pivot and said load will be clamped between said first and second jaws.

2. The clamping assembly of claim 1 wherein at lest one of said jaws is adapted to be mounted on said frame in either of two opposing directions, whereby the space between said jaws is adjustable.

3. A clamping assembly for use on a jack comprising:

a frame;

means for mounting said frame on a jack;

first and second jaws adapted to be mounted on said frame, said first jaw having a mounting portion and a clamping portion connected thereto, said mounting including first means for pivotably mounting said first jaw on said frame, said mounting portion further including means for contacting a load to be inserted between said jaws, whereby said first jaw is pivoted towards said second jaw, said second jaw including a mounting portion for fixedly mounting said second jaw on said frame.

4. The clamping assembly of claim 3 wherein said mounting portion and said clamping portion are oriented at substantially right angles relative to each other.

5. The clamping assembly of claim 3 wherein said second jaw includes a second means for pivotably mounting said second jaw on said frame.

6. The clamping assembly of claim 5 wherein said second jaw is identical to said first jaw.

7. The clamping assembly of claim 3 wherein said frame includes multiple frame mounting means whereby said first and second jaws may be mounted at various locations on said frame whereby the space between said jaws may be varied.

8. The clamping assembly of claim 3 wherein said first jaw mounting means comprises an aperture, said frame including a matching aperture, whereby a pin may be inserted through said frame and jaw apertures.

9. The clamping assembly of claim 3 wherein said first jaw mounting means comprises a pin, said frame including a slot for receiving said pin.

10. The clamping assembly of claim 3 wherein at least one of said jaws is adapted to be mounted in either of two opposing directions on said frame, whereby the space between said jaws may e varied.

11. The clamping assembly of claim 3 wherein said frame comprises two generally parallel elongated members.

12. A clamping assembly for use on a jack comprising:

a frame including a generally elongated member;

means secured to said frame for mounting said frame on a jack;

a pivot pin secured to said frame;

a first jaw including a first generally elongated leg adapted to be pivotably mounted on said pivot pin with said first leg generally aligned with said frame, and a second leg including a first jaw face connected to said first leg and extending generally at right angles to said first leg, said first jaw further including means for fixedly mounting said first jaw on said frame;

a second jaw including a second jaw face mounted on said frame spaced apart from and juxtaposed to said first jaw face;

means on said first leg for contacting a load inserted in the space between said first and second jaw faces for pivoting said first jaw whereby said first and second jaw faces will clamp said load.

13. The clamping assembly of claim 12 wherein said frame includes a plurality of jaw mounting means for mounting said jaws at various locations on said frame.

14. The clamping assembly of claim 14 wherein at least one of said first and second jaws are adapted to be mounted in either of two opposing directions on said frame, whereby the space between said jaw faces is adjustable.

15. The clamping assembly of claim 14 wherein said frame comprises two generally parallel elongated members.

* * * * *

UNITED STATES PATENT AND TRADEMARK OFFICE

CERTIFICATE OF CORRECTION

PATENT NO. : 4,811,931

DATED : March 14, 1989

INVENTOR(S) : Harold C. Bandy

It is certified that error appears in the above-identified patent and that said Letters Patent is hereby corrected as shown below:

Claim 2, Col. 5, line 62, change "lest" to --least--;
Claim 3, Col. 6, line 4, insert "portion" before --including--;
Claim 10, Col. 6, line 31, after "said" insert --first and second--;
Claim 10, Col. 6, line 33, change "e" to --be--;
Claim 14, Col. 6, line 60, change "14" to --12--;
Claim 15, Col. 6, line 65, change "14" to --12--.

Signed and Sealed this

Twentieth Day of June, 1989

*Attest:*

*Attesting Officer*

DONALD J. QUIGG

*Commissioner of Patents and Trademarks*